US009079298B1

(12) United States Patent
Stein

(10) Patent No.: US 9,079,298 B1
(45) Date of Patent: Jul. 14, 2015

(54) ADJUSTABLE SOCKET FOR A SOCKET WRENCH

(71) Applicant: Elias H Stein, Philadelphia, PA (US)

(72) Inventor: Elias H Stein, Philadelphia, PA (US)

( * ) Notice: Subject to any disclaimer, the term of this patent is extended or adjusted under 35 U.S.C. 154(b) by 0 days.

(21) Appl. No.: 14/601,484

(22) Filed: Jan. 21, 2015

(51) Int. Cl.
*B25B 13/30* (2006.01)
*B25B 13/44* (2006.01)

(52) U.S. Cl.
CPC ..... *B25B 13/30* (2013.01)

(58) Field of Classification Search
CPC ..... B25B 13/30; B25B 13/32; B25B 13/44
USPC ..... 81/116, 118
See application file for complete search history.

(56) References Cited

U.S. PATENT DOCUMENTS

| | | | | | |
|---|---|---|---|---|---|
| 55,107 | A | * | 5/1866 | Hoyt et al. | 81/118 |
| 102,336 | A | | 4/1870 | Ulley | |
| 360,874 | A | * | 4/1887 | Gent | 81/118 |
| 487,742 | A | | 12/1892 | Hunt | |
| 508,845 | A | * | 11/1893 | Schaller | 81/58.1 |
| 617,742 | A | * | 1/1899 | Harter | 81/73 |
| 643,632 | A | | 2/1900 | Cooper | |
| 650,742 | A | * | 5/1900 | Allen | 81/116 |
| 841,248 | A | | 1/1907 | Hill | |
| 917,364 | A | | 4/1909 | Sauer | |
| 920,372 | A | | 5/1909 | McDaniel | |
| 938,020 | A | | 10/1909 | Sauer | |
| 1,196,215 | A | | 8/1916 | Doherty | |
| 1,421,936 | A | | 7/1922 | Gilby | |
| 1,711,694 | A | | 5/1929 | Saffold | |
| 3,083,599 | A | | 4/1963 | Slagle | |
| 3,707,100 | A | * | 12/1972 | Roberts | 81/175 |
| 4,324,160 | A | | 4/1982 | MacLay | |
| 4,809,570 | A | | 3/1989 | Jeng | |
| 6,134,992 | A | * | 10/2000 | Perkins | 81/90.5 |
| 6,138,534 | A | | 10/2000 | Cho | |
| 6,923,096 | B1 | * | 8/2005 | Kim | 81/129 |
| 7,389,713 | B1 | * | 6/2008 | Chen | 81/155 |

* cited by examiner

*Primary Examiner* — David B Thomas
(74) *Attorney, Agent, or Firm* — Stuart E. Beck

(57) ABSTRACT

A socket for a socket wrench that can be adjusted to enable the socket to fit different size fasteners. The socket includes a cylindrical housing having an end wall with means on it for enabling the socket to be connected to a wrench handle.
The cylindrical housing comprises an elongated interior opening and a transverse opening for receiving a pivot pin.
A jaw comprising an elongated member disposed in the elongated interior opening and a second transverse opening in the jaw.
A pivot pin extends through the transverse openings in the housing and the jaw so that the jaw is pivotally connected to said housing so that one of its ends can be pivoted into engagement with a fastener.
A radially directed shaft is threaded through the housing and is in engagement with the jaw to bring into engagement with a fastener.

7 Claims, 5 Drawing Sheets

ADJUSTABLE SOCKET FOR A SOCKET WRENCH

FIELD OF THE INVENTION

This invention relates to a socket for a socket wrench that is useful for tightening and loosening threaded fasteners such as nuts and bolts.

BACKGROUND OF THE INVENTION

Presently, a mechanic or other person working with machinery such as factory equipment or automobiles has been required to have on hand a full set of sockets of varying sizes to meet the needs that are encountered. Typically both an American set of sockets and a metric set of sockets of varying sizes are required.

A typical set of sockets may include fifteen or twenty sockets of varying sizes ranging from about a half inch or one centimeter up to two to three inches or seventy or eighty centimeters.

It is desirable to have a socket that is adjustable to fit a large range of sizes of fasteners without regard to whether they are American or metric.

Such a socket would replace the myriad of sockets that a mechanic is presently required to have on hand. This would result in a lighter load that a mechanic would have to carry to a job, and simplify the selection of a socket for tightening or loosening a fastener as the case might be. Further, the ability of one socket to replace a myriad of sockets is economically advantageous to the mechanic since only one socket need be purchased.

SUMMARY OF THE INVENTION

With the foregoing in mind, the invention relates generally to a socket for a socket wrench that can be adjusted to enable the socket to fit different size fasteners, including a cylindrical housing having a cylindrical side wall and an end wall with means on it for enabling the socket to be connected to a wrench.

The cylindrical housing comprising an elongated interior opening defined by the end wall and the cylindrical sidewall and a transverse opening in the cylindrical sidewall for receiving a pin.

A jaw comprising an elongated member is in the elongated interior opening. Transverse openings are in the cylindrical side wall and in the jaw.

A pivot pin extends through the transverse openings in the side wall and the jaw so that the jaw is pivotally connected to said housing so that one of its ends can be pivoted into engagement with a fastener.

DETAILED DESCRIPTION OF THE PREFERRED EMBODIMENTS OF THE INVENTION

Figure 1A:
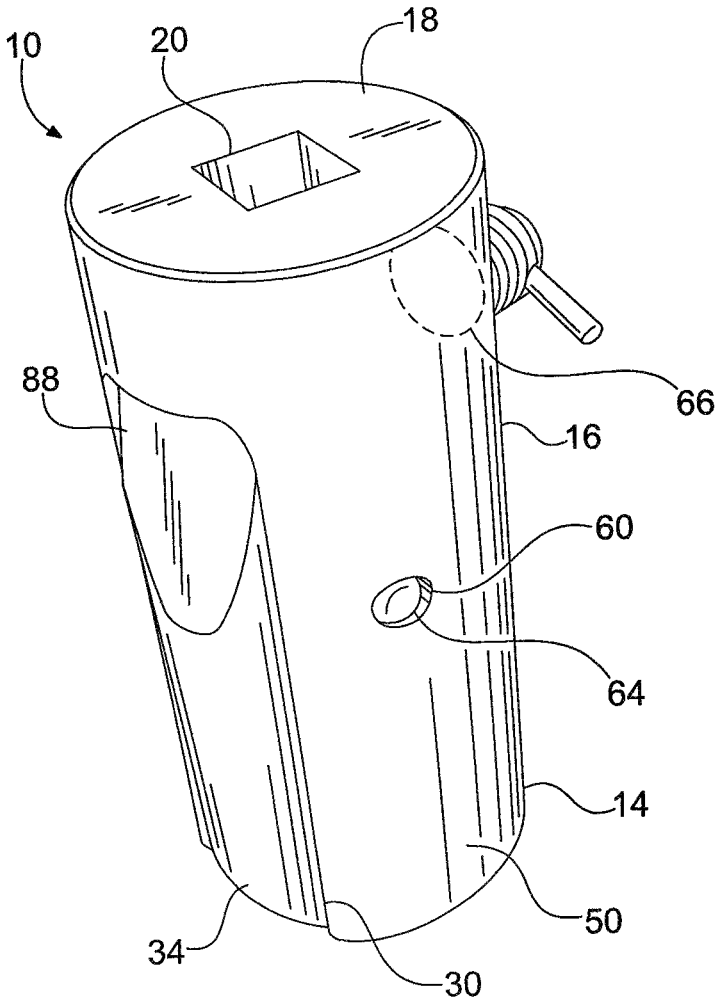
FIG. 1A is a pictorial view one embodiment of an adjustable socket in accordance with the invention.

Now referring to the drawing, FIG. 1A shows a detailed description of an adjustable socket 10 comprising one presently preferred form of the invention The adjustable socket 10 comprises a cylindrical housing 14 including a cylindrical side wall 16 and an end wall 18.

The end wall 18 may have a centrally located opening 20. Preferably, the opening is square and sized to receive a corresponding projection on a wrench handle by which it can be driven in a well known manner.

Figure 1B:
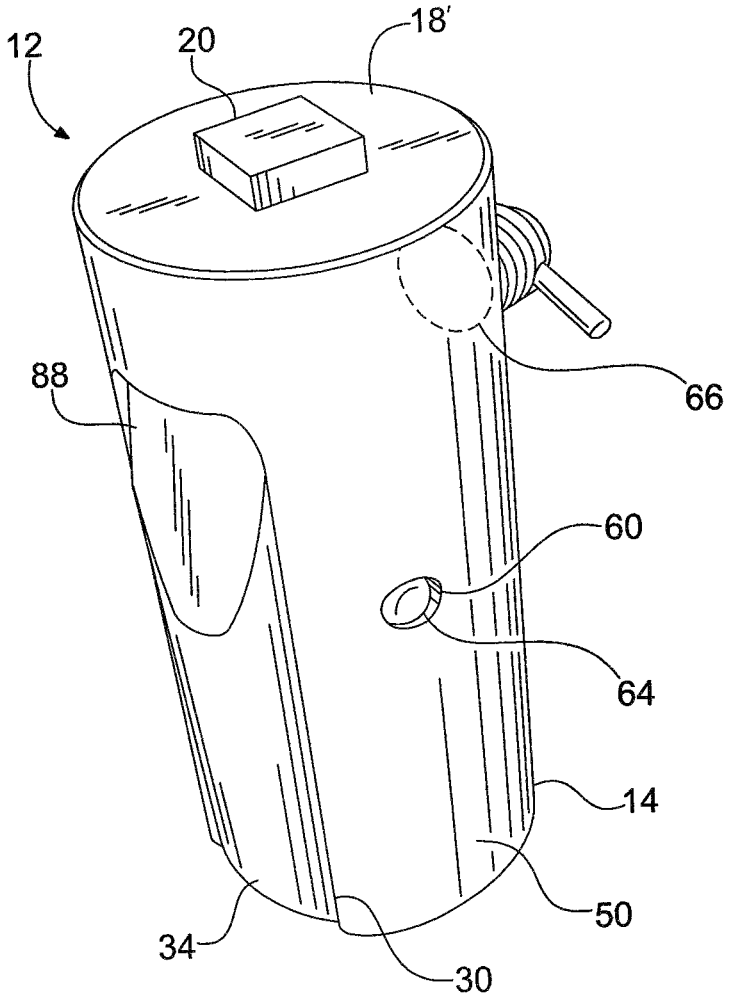
FIG. 1B is a pictorial view of a portion of the socket comprising another embodiment of the invention.

As seen in FIG. 1B, a second embodiment of the adjustable socket 12 comprises a cylindrical housing 14, a cylindrical wall 16 and an end wall 18. The end wall 18 supports a boss 20. The boss 20 may be rectangular or square to be received in a well known manner by the handle of a box or open end wrench.

Figure 2:
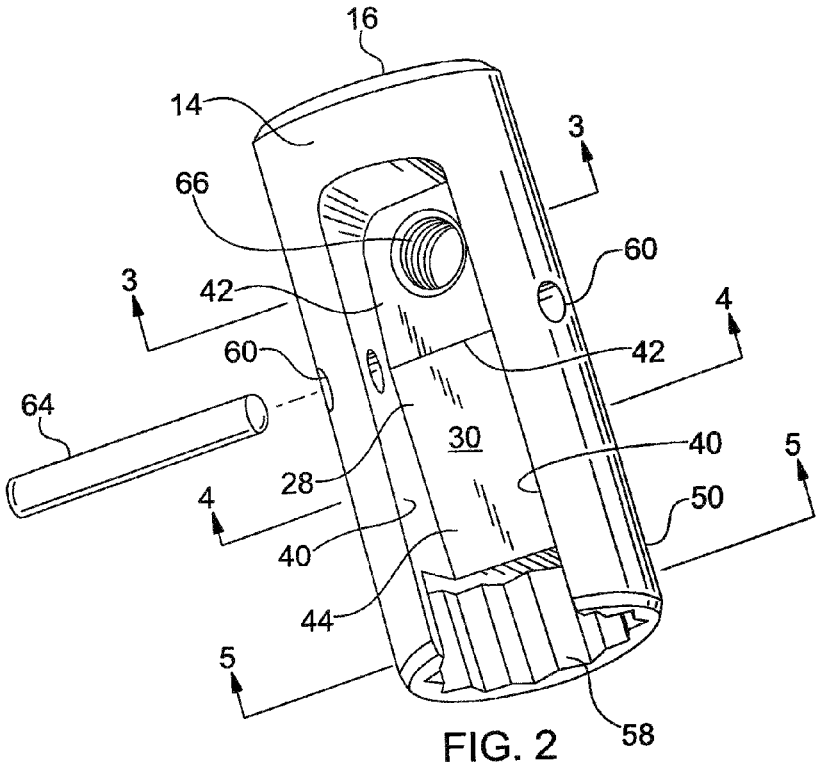
FIG. 2 is a view of the interior of a portion of the invention.
Figure 3:
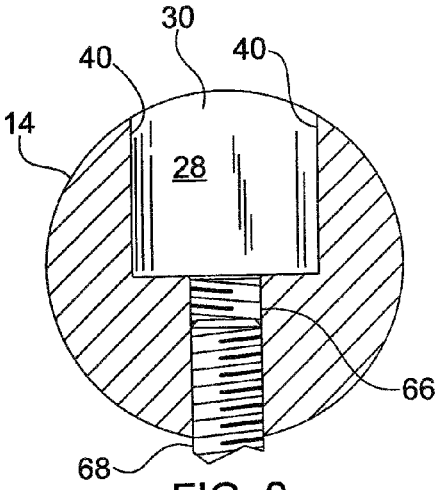
FIG. 3 is a section view taken along line 3-3 of FIG. 2.
Figure 4:
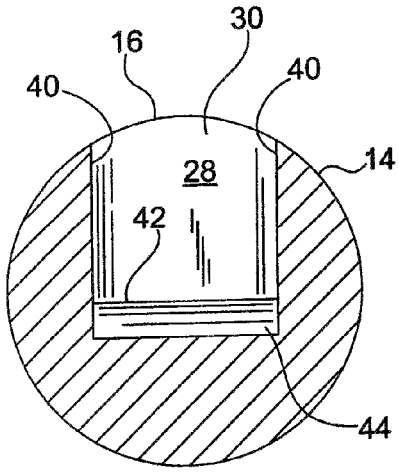
FIG. 4 is a section view taken along line 4-4 of FIG. 2.

As best seen in FIG. 2 the cylindrical housing 14 has an interior opening 28 which at its upper end is closed by end wall 16.

As further seen in FIGS. 1A and 1B a portion of the interior opening 28 includes a radial recess 30 in which an elongated pivotally mounted jaw 34 is located.

As best seen in FIGS. 2-5 the upper part of the interior opening 28 is generally channel shaped. It includes two parallel side walls 40 and a bottom wall 42. The lower portion 44 of the bottom wall 42 slopes radially outwardly so as not to interfere with the pivotal movement of the jaw 34.

The lower part of the interior opening 28 of the cylindrical housing 14 defines an apron 50 having a plurality of inwardly facing flutes 58 around its periphery. The flutes 58 are operative to engage the corners of a fastener (not shown) in a driving relation as is well known with socket wrenches.

Two aligned transverse openings 60 are provided in the cylindrical housing 14 above the bottom wall 42 of the interior generally channel shaped opening 28 to receive a pivot pin 64 as will be more fully explained.

The cylindrical housing 14 includes a radially directed opening 66 adjacent end wall 16. The radially directed opening 66 is disposed along an axis that is perpendicular to the axis of aligned transverse openings 60.

Preferably the radially directed opening 66 includes screw threads 68 for a purpose to be explained.

Figure 6:
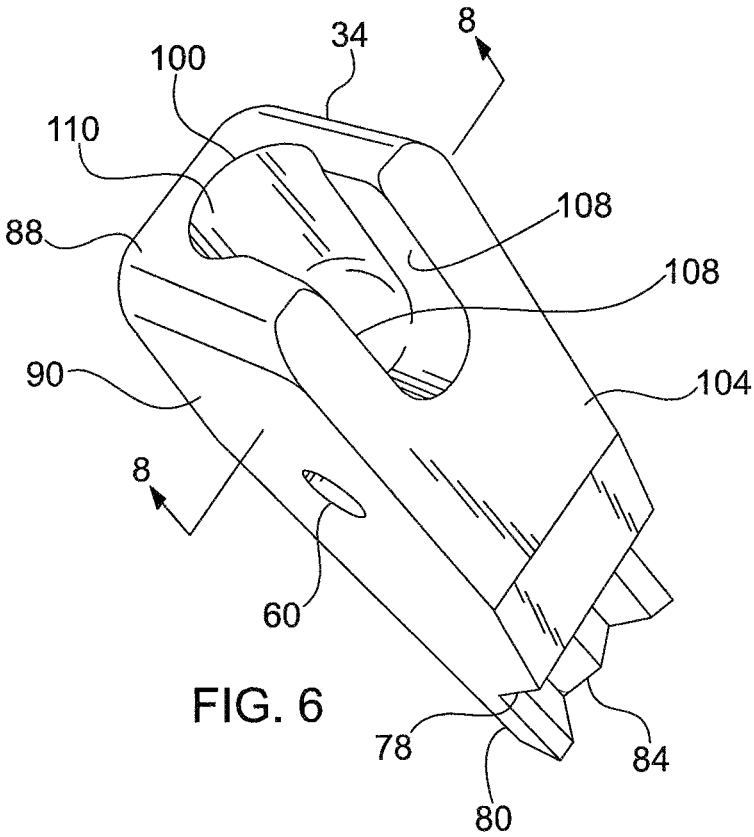
FIG. 6 is a pictorial view of the jaw of the invention.
Figure 7:
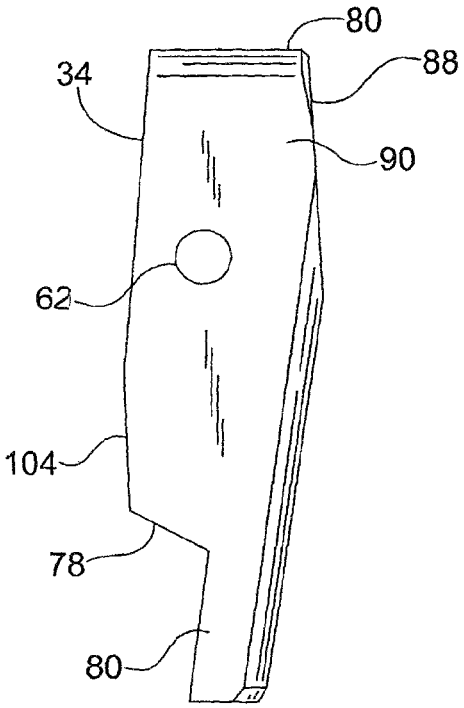
FIG. 7 is a side view of the jaw shown in FIG. 6
Figure 8:
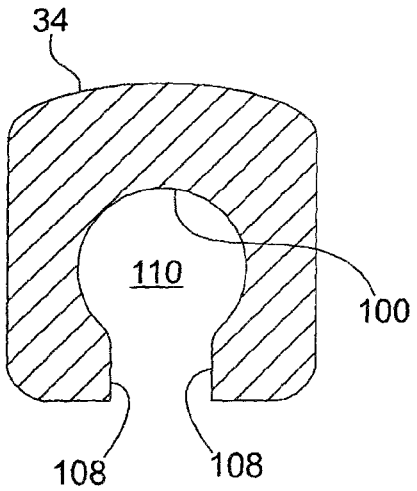
FIG. 8 is a section view taken along line 8-8 of FIG. 7.

As seen in FIGS. 6-8, the jaw 34 comprises an elongated member which is disposed in the interior opening 28. The jaw 34 includes a transverse opening 62. It is held in the interior opening 28 by transverse pin 64 for pivotal movement into and out of engagement with a fastener (not shown). The transverse pivot pin 64 extends through aforementioned aligned transverse openings 60 in the housing and the transverse opening 62 in the upper end of the jaw 34.

As seen in FIGS. 1-6 the jaw 34 is supported against lateral movement along the transverse pivot pin 64 by the parallel sidewalls 40 of upper part of the interior opening 28.

Figure 5:
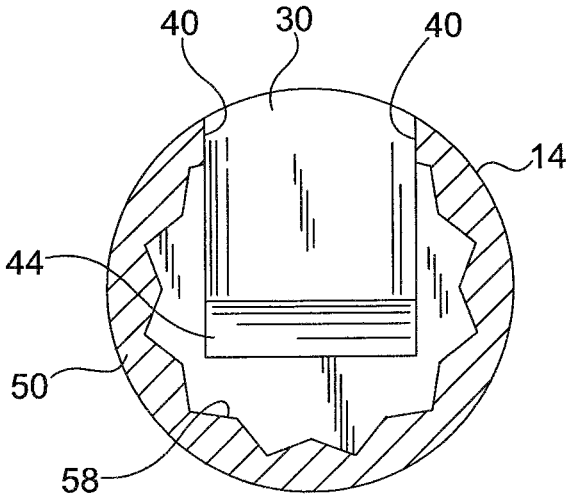
FIG. 5 is a section view taken along line 5-5 of FIG. 2.

The lower portion 78 of the jaw 34 is cut away to define an apron 80 that includes interior flutes 84. The outer wall of the jaw 34 has the same cylindrical curvature as the cylindrical housing 14. The apron 80 is the same size and shape as the apron 50 and flutes 84 are the same size and shape as the flutes 58 (FIG. 5). Thus, when the jaw 34 engages a fastener (not shown), flutes 58 and flutes 84 cooperate to hold the fastener.

A portion 88 of the upper part 90 of the jaw 34 has a slight taper to gradually reduce its cross section so that jaw 34 can pivot without hitting the end wall 16.

Transverse opening 62 in the upper part 90 of the jaw 34 is aligned with transverse openings 60 in the Referring now to FIGS. 6 and 8, an elongated notch 100 is in the upper end of inner wall 104 of the jaw 34.

The elongated notch 100 has generally parallel side sidewalls 108 that open into a rear chamber 110. The rear chamber 110 is circular in cross section and has a diameter that is slightly larger that the distance between the parallel side walls 108.

The upper end of the elongated notch 100 extends through the upper end of the jaw 34.

Figure 9:
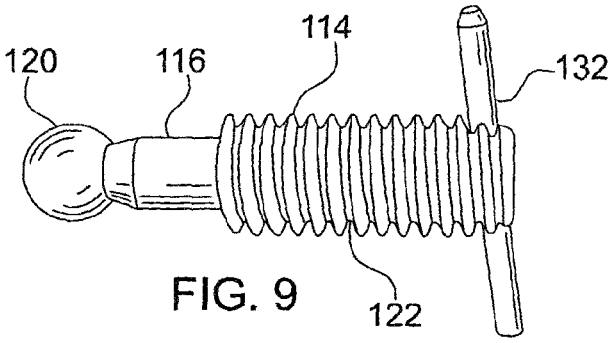
FIG. 9 is view of the adjustment pin of the invention.

A shaft 114 for adjusting the position of the jaw 34 relative to the cylindrical housing 14 is provided. As best seen in FIG. 9 at its distal end the shaft 114 comprises a cylindrical shaft of reduced diameter 116. The diameter of the cylindrical shaft 116 is slightly smaller than the distance across parallel side walls 108 so that they can move easily past each other.

The tip of the distal end of the shaft 114 comprises a sphere 120 that is received in the rear chamber 110. The diameter of the of the sphere 120 is slightly greater that the distance between the side walls 108. Thus, it can only be placed in the rear chamber 110 through the upper end of notch 100.

The other end 122 of shaft 114 is threaded. The shaft 114 is threadingly received in radially directed opening 66 as seen FIGS. 1A, 1B and 3. Thus, as the shaft 114 is rotated it advances in or retreats from the interior of the cylindrical housing 14

A suitable handle such as the crossbar 132 is provided to assist enabling rotation of the shaft 114 by hand.

The adjustable socket 10 is assembled by first threading shaft 114 through radially directed opening 66 in cylindrical housing 14 until the spherical tip 120 is in interior opening 28.

Then, the jaw 34 is placed in the cylindrical housing 14. The jaw 34 is slid toward the end wall 16 until the spherical tip 120 is received in the rear chamber 110. At this time the distal end will be between the parallel sidewalls 40. Since the diameter of the spherical tip 120 is greater than the distance across parallel sidewalls 40, the spherical tip 120 is trapped in interior opening.

The transverse opening 62 in the jaw 34 is aligned with the transverse openings 60 in the cylindrical housing 14.

Transverse pivot pin 64 is then slid through aligned openings 60 and 62 in the cylindrical housing 14 and the jaw 34 to complete the assembly.

The socket 10,12 is used to tighten or loosen a threaded fastener. The socket 10, 12 is placed over the fastener (not shown) and is adjusted by turning shaft 114 until the flutes 58 and 84 engage the fastener in a well known manner.

A wrench is then attached to the other end of the cylindrical housing 14 by engaging the opening 18 or the boss 20. The wrench can then be turned to drive the socket 10 to tighten or loosen the fastener as desired.

While the invention has been described with regard to certain presently preferred embodiments, it is apparent that other forms or embodiments will be obvious skilled in the art in view of the foregoing description.

Accordingly, the scope of the invention should not be limited by the foregoing description, but rather, only by the scope of the appended claims.

The invention claimed is:

1. A socket for a socket wrench that can be adjusted to enable the socket to fit different size fasteners, including a cylindrical housing, an end wall at one end of said cylindrical housing, means on said endwall for enabling it to be connected to a wrench handle, said cylindrical housing including an interior, said cylindrical housing comprising an elongated interior opening, said opening being defined by said end wall and said cylindrical sidewall;

a transverse opening in said cylindrical housing for receiving a pivot pin, a jaw, said jaw comprising an elongated member, said elongated member being disposed in said elongated interior opening;

a second transverse opening in said jaw;

said pivot pin extending through said transverse openings in said cylindrical housing and said jaw so that said jaw is pivotally connected to said housing, and a second opening extending through said cylindrical housing, a shaft threadingly received in said opening, one end of said shaft being connected to said jaw and the other end of said shaft extending through said second opening.

2. A device as defined in claim 1 wherein one end of said jaw is adapted to be pivoted around said pivot pin into engagement with a fastener.

3. A device as defined in claim 2 including said jaw including a notch, said notch including parallel sidewalls and a bottom wall, the distance across said bottom wall being greater than the distance between said parallel side walls.

4. A device as defined in claim 3 including a sphere at the distal end of said of said shaft, said sphere being received in said notch adjacent said bottom wall and being retained in said notch by said side walls.

5. A device as defined in claim 3 wherein the lower end of said cylindrical housing and said jaw each comprise an apron, and flutes on the interior of said aprons.

6. A device as defined in claim 1 wherein said means on said endwall for enabling it to be connected to a wrench handle comprises an opening in said end wall for receiving a portion of the wrench.

7. A device as defined in claim 1 wherein said means on said endwall for enabling it to be connected to a wrench handle comprises a boss having a plurality of sides for being received in a portion of the wrench having a corresponding number of sides.

* * * * *